US006151927A

United States Patent [19]

Owens et al.

[11] Patent Number: 6,151,927

[45] Date of Patent: Nov. 28, 2000

[54] CIRCULARLY KNIT BODY GARMENT

[75] Inventors: John T. Owens, Greenboro; Brewer Roberts, Graham, both of N.C.

[73] Assignee: Kayser-Roth Corporation, Greensboro, N.C.

[21] Appl. No.: 09/270,201

[22] Filed: Mar. 15, 1999

[51] Int. Cl.[7] ..... D04B 9/46; A41B 11/14

[52] U.S. Cl. ..... 66/178 R; 66/202

[58] Field of Search ..... 66/8, 17, 169 R, 66/170, 171, 172 R, 175, 177, 178 R, 180, 181, 182, 183, 184, 185, 186, 187, 178 A, 189, 202; 2/239, 240

[56] References Cited

U.S. PATENT DOCUMENTS

| | | |
|---|---|---|
| 3,098,369 | 7/1963 | Burleson et al. . |
| 3,306,081 | 2/1967 | Miles et al. . |
| 3,478,544 | 11/1969 | Homan . |
| 3,590,603 | 7/1971 | Jackson . |
| 3,651,670 | 3/1972 | Burleson et al. . |
| 3,751,354 | 8/1973 | Jones . |
| 3,889,494 | 6/1975 | Patience et al. . |
| 3,909,851 | 10/1975 | Garrou et al. . |
| 3,933,013 | 1/1976 | Cassidy, Sr. . |
| 3,956,906 | 5/1976 | Cassidy, Sr. . |
| 4,021,861 | 5/1977 | Imboden et al. . |
| 4,069,363 | 1/1978 | Segraves et al. . |
| 4,086,790 | 5/1978 | Hanrahan, Jr. et al. . |
| 4,253,317 | 3/1981 | Howard et al. . |
| 4,875,241 | 10/1989 | Browder, Jr. et al. . |
| 4,903,345 | 2/1990 | Oakley . |
| 5,038,414 | 8/1991 | Freeman . |
| 5,097,537 | 3/1992 | Ewing . |
| 5,115,650 | 5/1992 | Patrick et al. . |
| 5,127,109 | 7/1992 | Heitzman-Powell et al. . |
| 5,280,652 | 1/1994 | Davis et al. . |
| 5,319,950 | 6/1994 | Whitt et al. . |
| 5,533,212 | 7/1996 | Moretz et al. . |

OTHER PUBLICATIONS

Derwent Abstract for JP 5311501 A (Nov. 22, 1993).
Derwent Abstract for JP 9067702 A (Mar. 11, 1997).
Derwent Abstract for JP 48042130 A.
Derwent Abstract for JP 5148701 A (Jun. 15, 1993).
Derwent Abstract for JP 3064516 A ((Mar. 19, 1991).
Derwent Abstract for JP 1306637 A (Dec. 11, 1989).
Derwent Abstract for JP 10130905 A (May 19, 1998).

*Primary Examiner*—Danny Worrell
*Attorney, Agent, or Firm*—Kramer Levin Naftalis & Frankel LLP

[57] ABSTRACT

A pantyhose garment comprises a panty portion and two leg portions formed of circumferentially extending interknit courses of yarn. The panty portion provides greater compression than the leg portions. Both the panty and leg portions contain alternating courses of covered spandex yarn and body yarn. The spandex yarns in both the panty and leg portions are covered with bicomponent nylon yarn. The spandex yarn in the panty portion is of a larger denier than the spandex yarn in the leg portions, while the covering yarn on the spandex yarn in the leg portions is of a larger denier than the covering yarn on the spandex yarn in the panty portion. The resulting garment is a pantyhose with a generally uniform opacity throughout the panty and leg portions which nonetheless provides extra support in the panty portion. The invention also finds application in other circular knit garments.

20 Claims, 2 Drawing Sheets

CIRCULARLY KNIT BODY GARMENT

FIELD OF THE INVENTION

This invention relates to the general area of circularly knit body garments, and most preferably to pantyhose with a "control top" wherein the panty area has reinforced elastic strength to shape or to provide a smoothing effect on the contour of the wearer of the pantyhose.

DISCUSSION OF THE PRIOR ART

Pantyhose generally known as "control top" has a panty portion and two legs. The panty portion of such hosiery is made of elastic material which resists stretching for the purpose of shaping the figure of the wearer and/or providing a smoothing contour to the wearer of the pantyhose. Generally the panty is provided with compressive or shaping capabilities by incorporation of spandex yarn coupled with a body yarn.

In control top pantyhose, the yarns of the panty are different from the yarns of the legs. Generally they are relatively larger denier elastic yarns, as compared with smaller textured nylon yarns used in the legs. This is to provide resistance to stretching in the panty and consequent support in the panty area of the pantyhose.

A typical pantyhose of the control type will be formed of generally laterally extending yarn courses, which extend circumferentially around the panty portion and around each leg. Each such course is interknit with the adjacent courses, as is well known in the art. One type of control top pantyhose with sheer or non-support legs is made with nylon yarn in the legs and with a panty portion having spandex yarn in at least every other course. For example, the panty portion of control top hosiery might contain alternate courses of 70 or 120 denier spandex covered with 20 or 40 denier textured nylon. These spandex courses are conventionally interknit with adjacent courses which are of 40 or 70 denier textured nylon. The legs of such hosiery are conventionally made of courses of 20 to 40 denier textured nylon. Garments of this type have markedly greater opacity in the panty than in the leg.

Another conventional type of control top pantyhose which provides some measure of support in the legs has a panty portion containing alternating courses of 70 to 120 denier spandex, covered with 20 to 40 denier textured nylon, this being interknit with alternate courses of 40 to 70 denier textured nylon. The legs of such garments are formed with courses of 10 to 30 denier spandex, covered with 10 to 30 denier textured nylon, altematingly knit with 15 to 30 denier textured nylon. This type of garment also has markedly greater opacity in the panty portion relative to the leg.

It is also known to provide pantyhose that are "sheer-to-waist" and "fall support" in which the leg yarn is uniform throughout the garment, including the panty. In other words, the leg yarn is knit all the way to the top of the pantyhose without variation. In consequence, the compression strength or resistance to stretching in the panty is the same as in the leg and the appearance of the panty is uniform and consistent with the appearance of the leg. However, garments of this type do not provide extra support in the panty area.

Heretofore, it has not been possible to provide control top pantyhose having sufficient compression in the panty region and a sheer or light support construction in the legs, without also having markedly different opacity in the panty and leg portions of the garment. Since many wearers who enjoy the shaping benefits of control top pantyhose do not wish it to be evident that they use a figure enhancing garment, the difference in opacity between the leg and panty in control top hosiery is viewed by many to be undesirable.

Similarly, other types of circularly knit garments, such as, e.g., stockings, that have variations in resistance to stretching have had a marked difference in opacity between areas of different stretch, which may also be undesirable.

SUMMARY OF THE INVENTION

It is therefore an object of this invention to provide a circularly knit body garment having an elastic upper portion that provides extra compression; but which provides only slight to light compression in the lower portion thereof, wherein the differences in the opacity, texture and appearance of upper portion relative to the lower portion is minimal, and preferably virtually indistinguishable.

The foregoing objects are achieved by a pantyhose garment which comprises a panty portion and two leg portions cormected therewith. The panty portion and the leg portions are both formed of interknit courses of yarn extending in a generally circumferential direction of the garment, wherein the panty portion elastically resists stretching in the circumferential direction to a greater degree than the leg portions resist stretching in this direction, but which has little or no difference in the apparent opacity of the panty and leg portions of the garment.

More specifically, the advantages of the invention are achieved by using a structure wherein the courses of the panty portion alternate between a first panty course material and a second panty course material and the courses of the leg portion alternate between a first leg course material and a second leg course material. The first panty course material and the first leg course material each are spandex yarns which are conventionally covered with bicomponent nylon yarn. The second panty course material and the second leg course material are both nylon yarns of either conventional textured nylon, bicomponent nylon or flat trilobal.

The bicomponent nylon yarns which find application in the invention are comprised of filaments containing two different nylon polymers joined together. The nylon polymers used in bicomponent yarn have different shrinkage characteristics when exposed to heat. Compared to conventional nylon yarn, which is made of only one homogeneous polymer, bicomponent nylon has more consistent crimpage. Bicomponent nylon yarns of the type utilized in the invention are available from E.I. duPont de Nemours & Company and are sold under the trademark TECTEL DUO. Yarns sold by E.I. duPont de Nemours under designation Type 783 Bicomponent nylon are preferred yarns in the invention.

The spandex yarn of the first panty course is of a heavier denier than the spandex yarn of the first leg course. The spandex yarn in the first panty course is in the size range of 50 to 120 denier and is preferably 70 denier. The spandex yarn used in the leg of pantyhose according to the invention is in the range of 15 to 50 denier, preferably 20 to 40 denier, and most preferably 20 denier. Additionally, according to the invention, the spandex in the yarn in the panty portion of the garment has a denier which is 1.5 to 4.5 times larger than the denier of the spandex yarn utilized in the leg portion of the garment, and preferably 2.5 to 4.0 times larger than the spandex yarn in the leg, and most preferably 3.5 times larger.

The spandex yarn in the panty portion of the control top pantyhose of the invention is covered with a bicomponent nylon yarn in the size range of 8 to 25 denier, and preferably 11 to 18 denier, and most preferably 11 denier. Preferred covering yarns for the spandex course in the panty portion of pantyhose according to the invention are 11/5 TACTEL DUO (Type 783) and 18/8 TACTEL DUO (Type 783). In the foregoing nomenclature the first number in the designations 11/5 and 18/8 represents the total denier of the bicomponent nylon yarn and the second number represents the number of bicomponent nylon filaments in the yarn.

The spandex yarn in the leg portion of the control top pantyhose of the invention is covered with a bicomponent nylon yarn in the size range of 11 to 30 denier, and preferably 18 to 25 denier, and most preferably 18 denier. The preferred covering yarn for the spandex courses in the leg portion of the pantyhose according to the invention is duPont 18/8 TACTEL DUO (Type 783). In accordance with the invention, the bicomponent yarn utilized as a covering yarn in the spandex courses of the legs has a denier which is larger than the denier of the covering yarn in the panty portion of the inventive garment by a factor of 1.4 to 2.2, and preferably 1.5 to 2.0, and most preferably 1.6 to 1.8.

The nylon yarn of the second panty course and the second leg course of the pantyhose of the invention are yarns of substantially the same material, type and size, but which have a denier which is substantially smaller than the spandex yarn in the panty portion of the hosiery of the invention. According to the invention, the second course yarn in the panty and legs has a denier which is 20% to 40% of the denier of the spandex yarn in the panty portion of the garment, and preferably has a denier which is 25% to 35% of the denier of the spandex yarn utilized in the panty portion of the garment. Preferred second course yarns for the panty and leg portions of the pantyhose of the invention are 18/8 TACTEL DUO (Type 783), and 20/8 bright flat trilobal nylon yarn. Textured nylon yarns of 15 to 30 denier may also be used as second course yarns in the panty and leg portions of the inventive hosiery. For reasons of economy, it is preferred that the same yarn be used as a second course yarn in the panty and leg portions of the hosiery of the invention, but satisfactory results can be achieved when yarns of substantially the same material, type and denier are utilized as the second course in the panty and leg portions of the garment.

The inventors have found that when control top pantyhose is made as described above, the opacity, texture and overall appearance of the panty portion is essentially the same as the leg portion of the garment, resulting in a garment with no visible line between the panty portion and the leg portion, but which nevertheless provides conventional control top support in the panty portion of the garment.

Other objects and advantages of the present invention will become apparent from the specification herein, and the scope of the invention will be set forth in the claims.

DETAILED DESCRIPTION OF THE INVENTION

The invention herein is applicable to a variety of types of garments. Most preferably, the invention is applied and exemplified in the structural environment of pantyhose.

Figure 1:
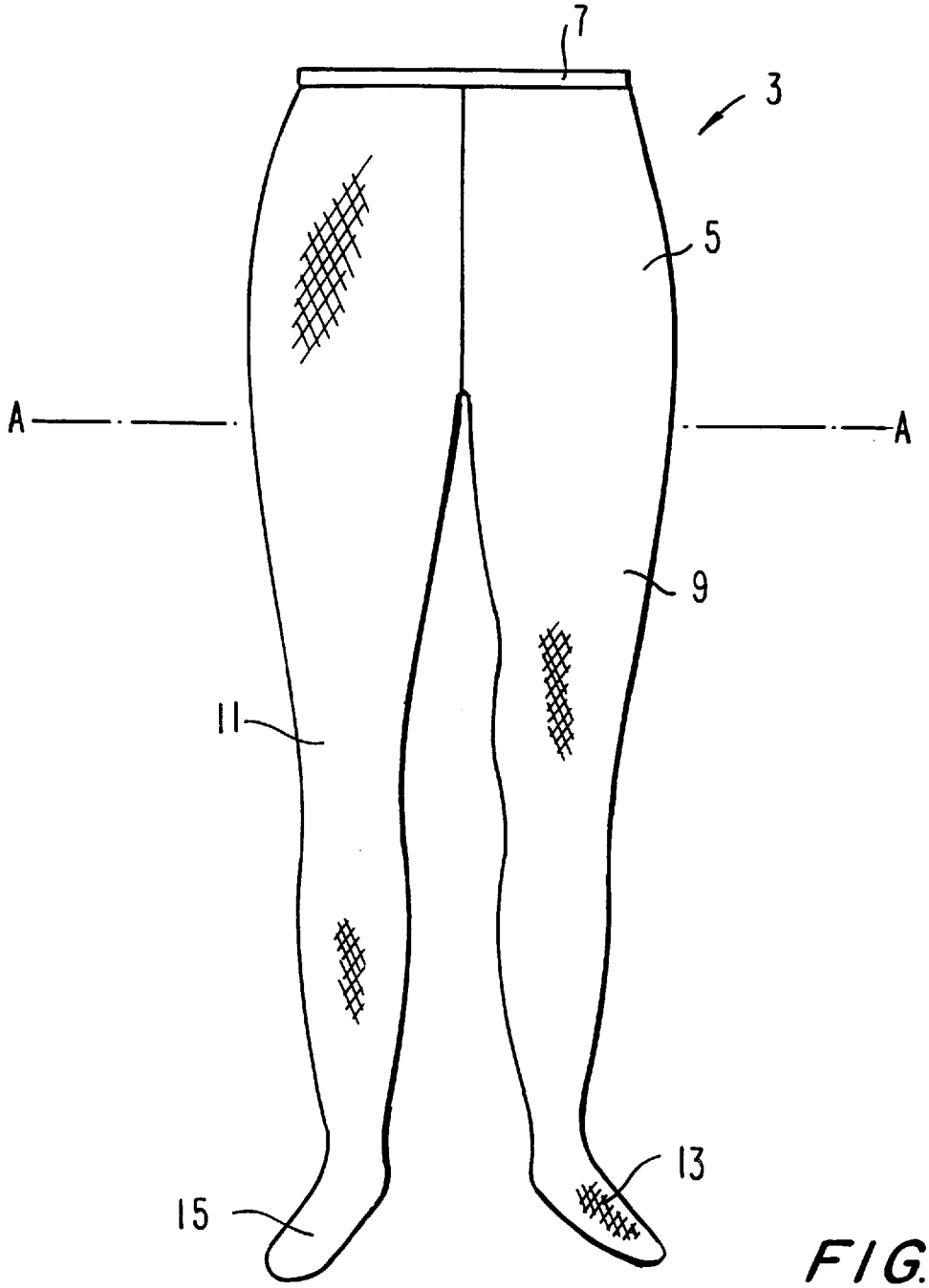
FIG. 1 is a front view of a pantyhose garment made according to the present invention being warn by an individual, which individual is not shown.

As best seen in FIG. 1, a pantyhose garment generally indicated at 3 is provided, which comprises a panty portion 5 having a waist band 7 of elastic material. The panty portion extends down approximately to line A—A, at which it connects with the left and right leg portions 9 and 11, which extend downward to end in the feet portions 13 and 15. Conventionally, panty portion 5 is seamed to join two circular knit hosiery tubes.

Figure 2:
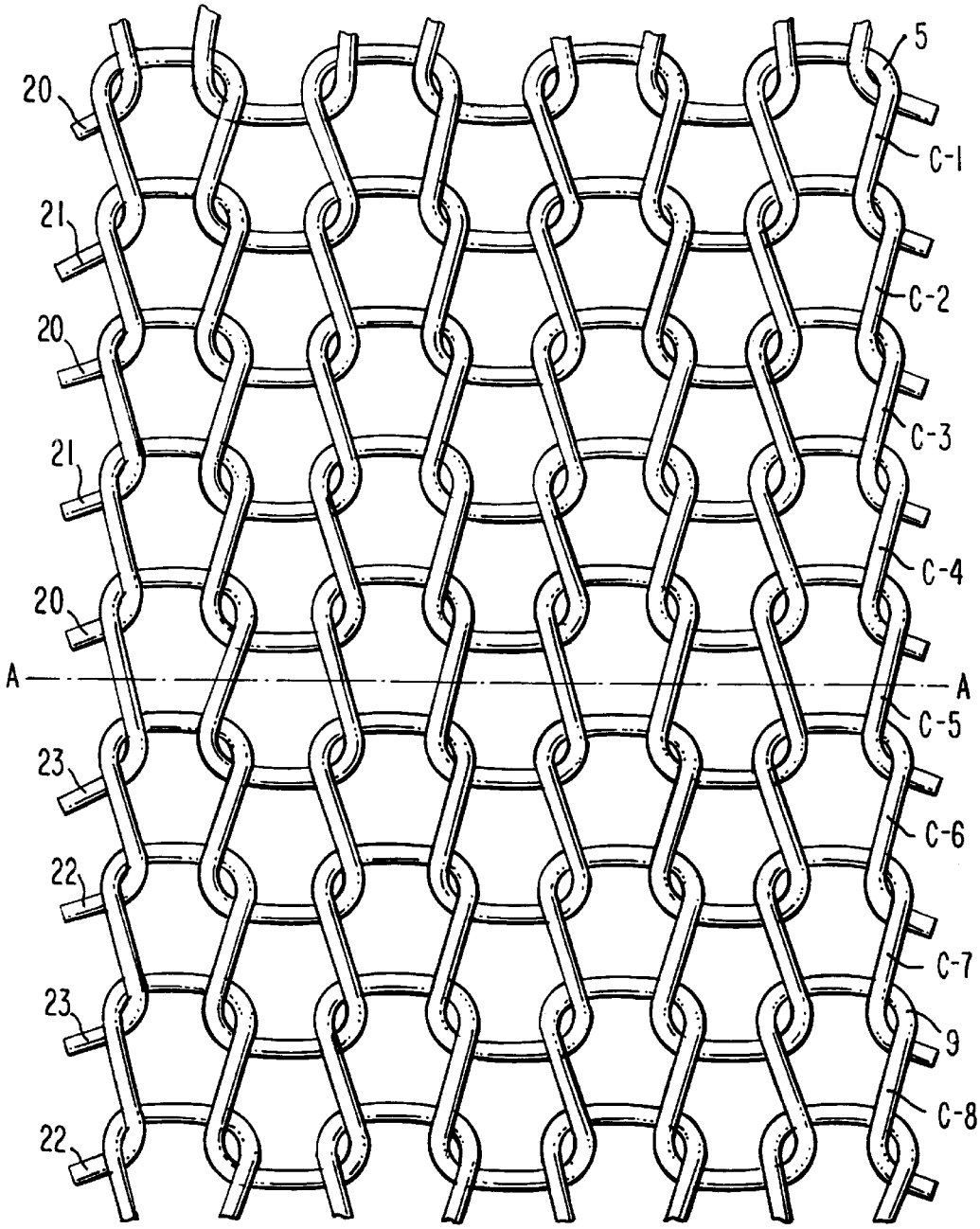
FIG. 2 schematically shows the knit courses of a pantyhose garment made according to the invention in the region of the border between the panty and leg portion of the pantyhose garment of FIG. 1.

Referring to FIG. 2, it will be seen that the panty portion 5 and the leg portion 9 or 11 are each formed of a large number of successive courses of stitched loops, illustrated by representative courses C-1 through C-8. These courses each extend generally in a circumferential direction, i.e., around the hips or the leg of the wearer.

The delimiter between the panty portions 5 and the leg portion 9 is generally indicated at the line A—A. First alternating courses C-1 and C-3 in the panty portion of the garment are knit with yarn 21, which is a spandex yarn covered in a conventional manner with a bicomponent nylon yarn as described above. The odd number courses in the leg of the garment, C-5 and C-7, are knit of yarn 23, which is also a spandex yarn covered with a bicomponent nylon. As described above, the relative sizes of the individual yarns which comprise yarns 21 and 23 are controlled to achieve the benefits of the invention.

In yarns 21 and 23, the spandex yarn is covered with bicomponent nylon yarn at between 30 and 80 wraps per inch, and preferably between 40 and about 60 wraps per inch ("TPI").

The alternating even numbered courses, C-2 and C-4, of panty portion 5 and C-6 and C-8 of leg portions 9, are knit with yarns 20 and 22. Preferably, yarns 20 and 22 are either the same yarns or are of substantially the same material, type and denier.

The resulting pantyhose garment 3 has a panty portion 5 which has an opacity, or a transparency, and an overall appearance which is essentially the same as leg portions 9 and 11.

The invention is further exemplified herein by the following examples:

EXAMPLE 1

A control top pantyhose garment according to the invention was knit by mechanical means well known in the art with the following construction.

In the Panty portion, alternating courses of:

1. 70 denier spandex yarn covered with an 11/5 duPont TACTEL DUO bicomponent nylon yarn (Type 783); and
2. 18/8 duPont TACTEL DUO bicomponent nylon yarn (Type 783).

In the Leg portion, alternating courses of:

1. 20 denier spandex yarn covered with an 18/8 dupont TACTEL DUO bicomponent nylon yarn (Type 783); and
2. 18/8 duPont TACTEL DUO bicomponent nylon yarn (Type 783).

The resulting pantyhose has substantially the same opacity, texture and appearance in the panty and the leg portions, such that the boundary between the panty and the leg portion is difficult to perceive when the garment is in an unstretched or stretched (worn) condition.

EXAMPLE 2

A control top pantyhose garment according to the invention was formed as follows:

In the Panty portion, alternating courses of:

1. 70 denier spandex yarn covered at 60 TPI with 11/5 TACTEL DUO of Type 783 yarn; and
2. 20/8 bright flat trilobal nylon yarn.

In the Leg portion, alternating courses of:

1. 20 denier spandex yarn covered with 18/8 TACTEL DUO of Type 783 yarn;

and 2. 20/8 bright flat trilobal nylon yarn.

The resulting pantyhose also showed a close correlation in opacity, texture and overall appearance between the panty and the leg portions while providing excellent figure control in the panty portion.

EXAMPLE 3

A control top pantyhose garment according to the invention was formed as follows:

In the Panty portion, alternating courses of:

1. 70 denier spandex covered with 11/5 nylon TACTEL DUO of Type 783 yarn; and
2. 18/8 TACTEL DUO of Type 783 yarn.

In the Leg portion, alternating courses of:

1. 40 denier spandex yarn covered with an 18/8 TACTEL DUO Type 783 yarn; and
2. 18/8 TACTEL DUO Type 783 yarn.

EXAMPLE 4

An embodiment according to Example 2 above uses, instead of the 60 turn per inch 44 turn per inch to cover the spandex yarn in the panty portion of the garment.

EXAMPLE 5

A pantyhose as in Example 3 above except that the spandex yarn in the panty portion is 120 denier instead of 70 denier, and the spandex yarn in the leg portion of the garment is 70 denier instead of 40 denier.

Although the invention herein is disclosed mainly in the context of pantyhose, it will be understood by those in the art that the invention may equally apply to other garments such as stockings, tights, body suits, socks, etc. The terms used herein should be considered to be terms of description rather than limitation as those of skill in the art with this specification before them will be able to make modifications and additions thereto without departing from the spirit of the invention disclosed.

What is claimed is:

1. A circular knit body garment comprising:

a first body portion knit of successive alternating courses of a first elastic yarn and a first body yarn and a second body portion knit of successive alternating courses of a second elastic yan and a second body yarn, said first and second body portions being circularly interknit to provide a seamless transition between said first and second body portions;

said first elastic yarn having a denier in the range of about 50 to 120, said second elastic yarn having a denier in the range of about 15 to 50, and the denier of said first elastic yarn being about 1.5 to 4.5 times larger than the denier of said second elastic yarn;

said first elastic yarn being covered with a first covering bicomponent nylon yarn having a denier in the range of about 8 to 25, said second elastic yarn being covered with a second covering bicomponent nylon yarn having a denier in the range of about 11 to 30, the denier of said second covering yarn being 1.4 to 2.2 times larger than the denier of the first covering yarn;

said first and second body yarns being comprised of bicomponent nylon yarn, textured yarn or flat trilobal yarn; and said first body portion and said second body portion having substantially the same opacity.

2. A circular knit body garment according to claim 1 wherein said first and second body yarns are the same type of yarn and have substantially the same denier.

3. A circular knit body garment according to claim 2 wherein the denier of said first body yarn is 20% to 40% of the denier of said first elastic yarn.

4. A circular knit body garment according to claim 1 wherein said first and second elastic yarns are spandex yarns.

5. A circular knit body garment according to claim 3 wherein first and second elastic yarns are spandex yarns.

6. A circular knit body garment according to claim 1 wherein said first and second body yarns are bicomponent nylon yarns.

7. A circular knit body gannent according to claim 3 wherein said first and second body yarns are bicomponent nylon yarns.

8. A circular knit body garment according to claim 1 wherein said first and second body yarns are flat trilobal nylon yarns.

9. A circular knit body garment according to claim 3 wherein said first and second body yarns are flat trilobal nylon yarns.

10. A circular knit body garment according to claim 4 wherein said first elastic yarn is 70 denier spandex, said second elastic yarn is 20 denier spandex and said first covering yarn has a denier which is 1.5 to 2.0 times larger than the denier of said second covering yarn.

11. A circular knit body garment according to claim 4 wherein said first covering yarn has a denier which is 1.6 to 2.0 times larger than the denier of second covering yarn.

12. A circular knit body garment according to claim 11 wherein said first and second covering yarns are wrapped respectively about said first and second elastic yarns with about 30 to 80 wraps per inch.

13. A circular knit body garment according to claim 11 wherein said first and second covering yarns are wrapped respectively about said first and second elastic yarns with about 40 to 60 wraps per inch.

14. A knit pantyhose comprising:

a panty portion configured to receive therein at least a portion of a wearer's hips; and two leg portions connected with the panty portions and each being configured to receive therein a respective leg of the wearer;

the panty portion and the leg portions being formed of interknit courses extending in a circumferential direction of the garment, each course being interknit with at least two adjacent courses so that the panty portion is connected seamlessly with the leg portions;

the panty portion elastically resisting elasticing in the circumferential direction to a greater degree than the leg portions resist elasticing in the circumferential direction;

the courses of the panty portion alternatingly comprising a first panty course yarn and a second panty course yarn, and the courses of the leg portions altematingly comprising a first leg course yarn and a second leg course yarn;

the first panty course yarn and the first leg course yarn each being spandex yarn covered with bicomponent nylon yarn;

the second panty course yarn and the second leg course yarn both being nylon yarns;

the spandex yarn of the first panty course yarn being of a denier of about 70 and the spandex yarn of the first leg course yarn being a denier of about 20, the spandex yarn of the first panty course yarn providing greater elastic elastic resistance than the spandex yarn of the first leg course yarn;

the bicomponent nylon yarn of the first leg course yarn having a denier about 1.6 to 2 times the denier of the bicomponent nylon yarn of the first panty course yarn; and the panty portion and the leg portion having substantially similar opacities.

15. The pantyhose garment according to claim 14 wherein the nylon yarn of the second panty course yarn and of the second leg course yarn are bicomponent nylon yarns of substantially the same denier.

16. The pantyhose garment according to claim 14 wherein the nylon yarn of the second panty course yarn and of the second leg course yarn are flat trilobal nylon yarns of substantially the same denier.

17. The pantyhose garment according to claim 15, wherein the second panty course yarn is 18/8 bicomponent nylon yarn.

18. The pantyhose garment according to claim 17, wherein the second leg course yarn is 18/8 bicomponent nylon yarn.

19. The pantyhose garment according to claim 14, wherein the bicomponent nylon yarn is twisted around the first panty course yarn and the first leg course yarn at about 30 to 80 wraps per inch.

20. The circular knit body garnent according to claim 1, wherein the body garment is a pantyhose garment, the first body portion being a panty portion, and the second body portion being a leg attached seamlessly to the panty portion.

* * * * *